United States Patent [19]

Arnoldi, deceased et al.

[11] Patent Number: 4,705,413

[45] Date of Patent: Nov. 10, 1987

[54] THICKNESS COMPENSATING MEANS FOR MAILING MACHINE

[75] Inventors: Walter E. Arnoldi, deceased, late of Southbury; Walter E. Arnoldi, administrator, West Hartford, both of Conn.

[73] Assignee: Pitney Bowes Inc., Stamford, Conn.

[21] Appl. No.: 886,600

[22] Filed: Jul. 18, 1986

[51] Int. Cl.[4] ..... B41F 13/20; B41J 11/20

[52] U.S. Cl. ..... 400/56; 101/91; 101/232; 400/58

[58] Field of Search ..... 400/55-60; 101/91, 234, 232, 233; 271/2

[56] References Cited

U.S. PATENT DOCUMENTS

| | | | |
|---|---|---|---|
| 388,366 | 8/1888 | Laass et al. | 101/234 |
| 3,217,639 | 11/1965 | Kelly | 101/91 |
| 3,381,790 | 5/1968 | Chaveneaud | 101/91 |
| 4,170,350 | 10/1979 | Conti | 101/232 |
| 4,170,422 | 10/1979 | Bilek | 400/55 |
| 4,361,086 | 11/1982 | Simonotti et al. | 271/2 |
| 4,461,212 | 7/1984 | Geney | 101/234 |
| 4,620,807 | 11/1986 | Polit | 400/56 |

FOREIGN PATENT DOCUMENTS

| | | | |
|---|---|---|---|
| 24662 | 3/1981 | European Pat. Off. | 400/56 |
| 2844150 | 4/1979 | Fed. Rep. of Germany | 400/58 |
| 111281 | 8/1980 | Japan | 400/55 |
| 152975 | 9/1982 | Japan | 400/58 |

OTHER PUBLICATIONS

Archer, "Low Cost Single Line Printer" IBM Technical Disclosure Bulletin, vol. 27, No. 113, pp. 637-638 6-84.

*Primary Examiner*—William Pieprz

*Attorney, Agent, or Firm*—Charles G. Parks, Jr.; David E. Pitchenik; Melvin J. Scolnick

[57] ABSTRACT

The thickness compensation means includes an upper and lower reaction roller. The upper reaction roller is rotatably mounted to a mailing machine in fixed location. A bracket is pivotally mounted to the mailing machine for rotatably supporting the lower reaction roller in tangential radial alignment with the upper reaction roller. The bracket is biased in a first direction to urge the lower reaction roller through an accommodating opening in the mailing machine platen into tangential communication with the upper reaction roller. The bracket further rotatably supports an impression roller in tangential alignment to the print drum of a postage meter coupled to the mailing machine. The bracket and supported rollers are so positioned relative to the imprinting station of the mailing machine that a longitudinally traversing mailpiece is first encountered by the reaction rollers causing the bracket to pivotally deflect in a second direction resulting in prepositioning of the impression roller relative to the postage meter print drum in accordance with mailpiece thickness for subsequent indicia printing on the mailpiece.

2 Claims, 3 Drawing Figures

THICKNESS COMPENSATING MEANS FOR MAILING MACHINE

FIELD OF THE INVENTION

The present invention relates to postage meter mailing systems and, more particularly, to a system and apparatus for providing mailpiece thickness compensation antecedent to the printing cycle of the postage meter.

BACKGROUND OF THE INVENTION

Most conventional high speed postage meter mailing systems include a high speed envelope feeder, a mailing machine, a postage meter cooperatively coupled to the mailing machine and a receiving bin or other suitable apparatus. Briefly, the envelope feeder receives a stack of envelopes or other mailpieces and feeds the individual mailpieces to the mailing machine transport system in a segregated manner. Each mailpiece is then delivered to an indicia printing station for postage indicia printing by the postage meter. Subsequent thereto, the mailpiece is discharged to a receiving bin or other appropriate apparatus. The system is designed to act as a continuous process.

The afore briefly described process has as one of its objectives the ability to accommodate various thicknesses in mailpieces. To facilitate this objective, it is known for systems of this type and related denomination to provide a deflectable mailing machine platen at the printing station. The mail machine platen conventionally includes a lower impression roller rotatably mounted thereto. The print drum of the postage meter is rotatably mounted in a fixed location and includes a surface flat. In the print drum home position, the surface flat is located in spaced apart radial alignment to the mailing machine impression roller to define a mailpiece receiving gap. Ideally, the leading edge of an incoming mailpiece to the indicia printing station is received within the gap at which time print drum rotation is initiated. The mailpiece impression region of the mailpiece then being friction secured tangentially between the print drum and impression roller. The platen is deflected in response to the incoming mailpiece a commensurate distance corresponding to mailpiece thickness. As a result, excessive loads generated by communication between the print drum, mailpiece and impression roller due to mailpiece thickness are ideally translated to a deflection of the platen.

It has been found that in such mailing system the ideal condition does not prevail, i.e., during the postage meter impression cycle, the print drum and supporting structure are subjected to substantial loading. In a worse-case, the mailpiece thickness is approximately equal to or slightly greater than the gap distance, wherein the incoming mailpiece is initially wedged between the print drum rearward flat transverse edge and the platen, slightly rearward of the mailpiece's leading edge. The wedge position of the mailpiece upon initiation of print drum rotation causes the print drum to experience excessively high loading to which platen deflection cannot adequately respond. As a result of the excessive loading condition of the print drum, which is transmitted to the print drum drive and support structure, premature motor and bearing failure is promoted. Meter failure is further hastened due to the harmonic nature of the loading and increased motor torque required to drive the print drum upon initiation of rotation. It is appreciated, that high system torque requirement carrying therewith the associated system degrading factor, e.g., increased power consumption, heat build-up, etc. In the worse-case, the meter unit itself may experience visually discernible harmonic deflection resulting in the generation of excessive noise.

SUMMARY OF THE INVENTION

It is therefore an object of this invention to provide a mailing machine for cooperative association with a compatible postage meter which association is substantially divorced of the above-noted disadvantages.

Another object of this invention is to provide a mailing machine with improved mailpiece thickness compensation means.

Still yet another object of this invention is to provide a mailing machine which cooperates with a postage meter or other indicia printing device wherein there is substantially less strain inflicted on the postage meter or other device, thus increasing its useful life of the postage meter or other device.

Another further object of this invention is to provide a mailing machine which provides a more uniform mailpiece impression surface resulting in substantially less indicia distortion on the printed mailpieces.

These and other objects are accomplished by this invention generally speaking by providing a mailing machine wherein reaction rollers are placed adjacent the printing station in order to preposition the impression roller. The extent of this prepositioning depends upon the thickness of the mailpiece being fed therethrough. The lower reaction roller is connected to the impression roller by a common shaft or axle which allows the displacement of the reaction roller to proportionally displace the impression roller. Thus, when a mailpiece passes between the reaction rollers it displaces the lower reaction roller in accordance with its thickness. The lower reaction roller then moves the impression roller away from the surface of the meter print drum, a distance which coincides with the mailpiece thickness. The interaction between the meter print drum and the mail is substantially identical for all thicknesses of mail. Improvements in mail processing provided by this invention include thicker mail capacity and reduced operating stresses on the meter print drum. Prepositioning the impression roller by the thickness of the mailpiece keeps the top surface of the mailpiece tangential to the circular path of the print drum. Longer acceleration periods are possible and, most importantly, impression roller displacement loads are not transmitted to the postage meter. The upper reaction roller is directly mounted to the mailing machine structure as is the meter. The lower reaction roller is mounted on a pivoted impression roller bracket. The impression roller is on the same shaft as the prepositioning or lower reaction roller. This shaft remains parallel to the meter drum axis and therefore the mail thickness encountered by the reaction rollers prepositions the impression roller. The meter drum axis is slightly downstream from the other rollers to ensure positive mail control before contact with the meter drum thus allowing its full acceleration.

A spring and damper conveniently control motion of the impression roller bracket while providing the printing preload force. The present invention provides a system where a pressure-sensitive reaction roller is connected on the same axle or shaft as the impression roller. Thus, rather than the platen moving, the reaction roller moves causing a corresponding movement in the impression roller thereby resulting in a more uniform image on the mailpiece above the impression roller. The impression roller and the reaction roller are not in functional relationship with the meter motor. Thus, the radial and tangential force on the print drum and the drum motor is substantially reduced. This improves durability of not only the drum but the motor which provides the impetus for the drum. In addition, there is less noise and better print impression provided. The periphery of the reaction or impression rollers are generally elastomeric which are deflected at uniform degrees of flexibility upon contact with the mailpiece.

BRIEF DESCRIPTION OF THE DRAWING

A preferred embodiment of the invention is described by way of example with reference to the accompanying drawing in which.

DESCRIPTION OF THE DRAWING AND PREFERRED EMBODIMENT

Figure 1:
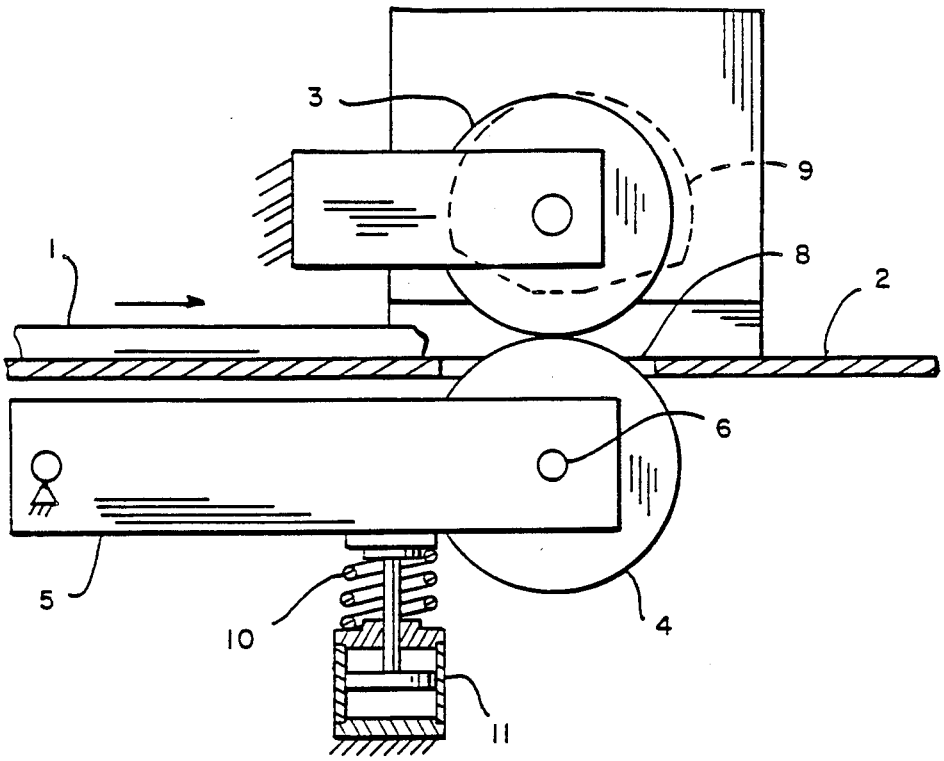
FIG. 1 is a side schematic elevation of the novel portion of the mailing machine during use supporting the mailpiece being fed therethrough.
Figure 2:
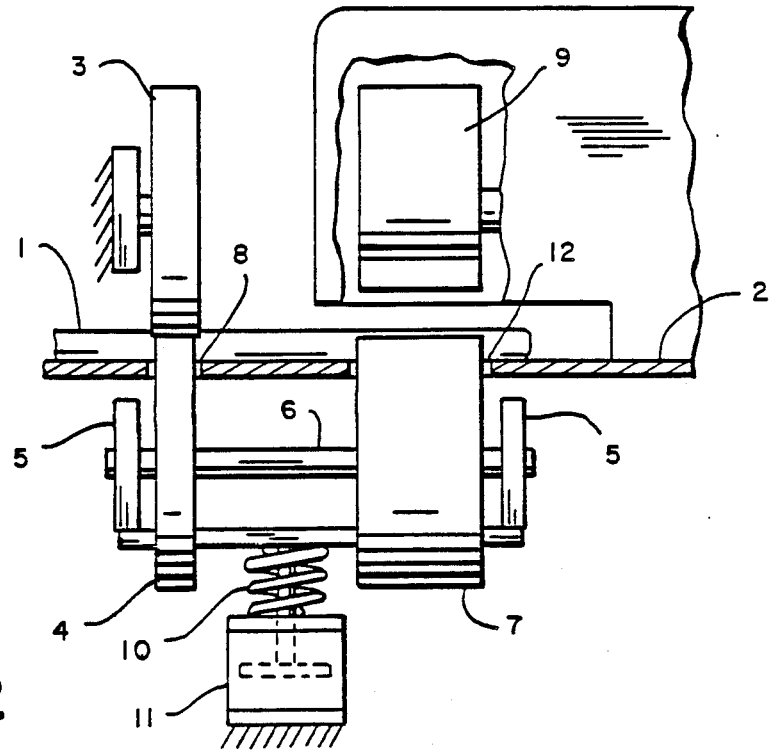
FIG. 2 is a front schematic elevation of the novel portion of the mailing machine of this invention.

In FIG. 1, mailpiece 1 is shown supported by mail deck or platen 2 just prior to contacting upper reaction roller 3 and lower reaction roller 4. Lower reaction roller 4 is pivotally or movably mounted on bracket 5 having a shaft or axle 6 which extends through to the opposite side of bracket 5 thereby connecting lower reaction roller 4 to impression roller 7 as shown in FIG. 2. The upper reaction roller 3 is rigidly mounted with its height set slightly above the corresponding height of the meter drum. Platen 2 is stationary or fixed in place but has cut out portions 8 through which the lower reaction roller projects beyond the upper surface of mail deck or platen 2. When the mailpiece 1 is positioned between rollers 3 and 4, roller 4 is displaced in proportion to the thickness of mailpiece 1. When lower reaction roller 4 is displaced, it also moves impression roller 7 downward to the same position since both impression roller 7 and reaction roller 4 have the same diameter and the same axle or shaft 6. Thus, the shaft 6 remains parallel to the meter drum axis and therefore the mail thickness encountered by rollers 3 and 4 prepositions the impression roller 7. The supporting surface for the printing pressure is impression roller 7 which is located directly below meter drum 9. The meter drum 9 generally makes one revolution on demand to print indicia on mailpiece 1. The interaction between the mailpiece 1 and the meter drum 9 is substantially identical for all thicknesses of traversing mail.

In the present invention displacement of impression roller 7 is completely independent from the meter drum and is rather directly proportional to the downward displacement of reaction roller 4. Bracket 5 is connected to spring means 10 and damper 11 which control motion of reaction roller 4 and impression roller 7 and provides the printing preload force and motion control. Once the mailpiece has passed through rollers 4 and 7 the bracket 5 springs back up to its original position awaiting the delivery of the next mailpiece. Rollers 3 and 4 also serve to keep the mailpiece down in position so that at the printing station the meter drum 9 does not prematurely contact the mailpiece thus creating a distorted image. This is due to the velocity difference of the transport (mailpiece) and the meter (indicia). All of the rollers are constructed from any suitable materials such as plastic or metal with a rubber, vinyl, urethane or other synthetic surface. In some preferred embodiments the elastomeric construction of the surface of impression roller 7 maintains print pressure over local variations in the mail. The concept of this invention can additionally be used when an ink jet system is used in place of print drum. In an ink jet system the distance from the jet to the mailpiece is critical and would be very appropriate for use with the present invention. While the disclosure and claims herein use the term "print drum" other suitable marking means are included such as ink jet systems and these can be used in lieu of print drums. Thus, the term "print drum" includes any suitable marking means.

In FIG. 2 the common axle or shaft 6 connecting impression roller 7 with lower reaction roller 8 can clearly be seen. Platen openings 8 through which the reaction roller 4 projects provides roller 4 with access to mailpieces 1. Also, space or openings 8 allow movement of rollers 4 downwardly upon contact with mailpiece 1. Openings 12 correspondingly permit impression roller 7 to move downward to the same extent as roller 4. Rollers 3 and 4 are driven by any conventional motor but they are completely separate from the motor that supplies power to the meter and motor drum 9. Spring means 10 allow the entire bracket 5 and its assembly including rollers 4 and 7 to spring back to its rest position after the mailpiece 1 has passed therethrough.

Figure 3:
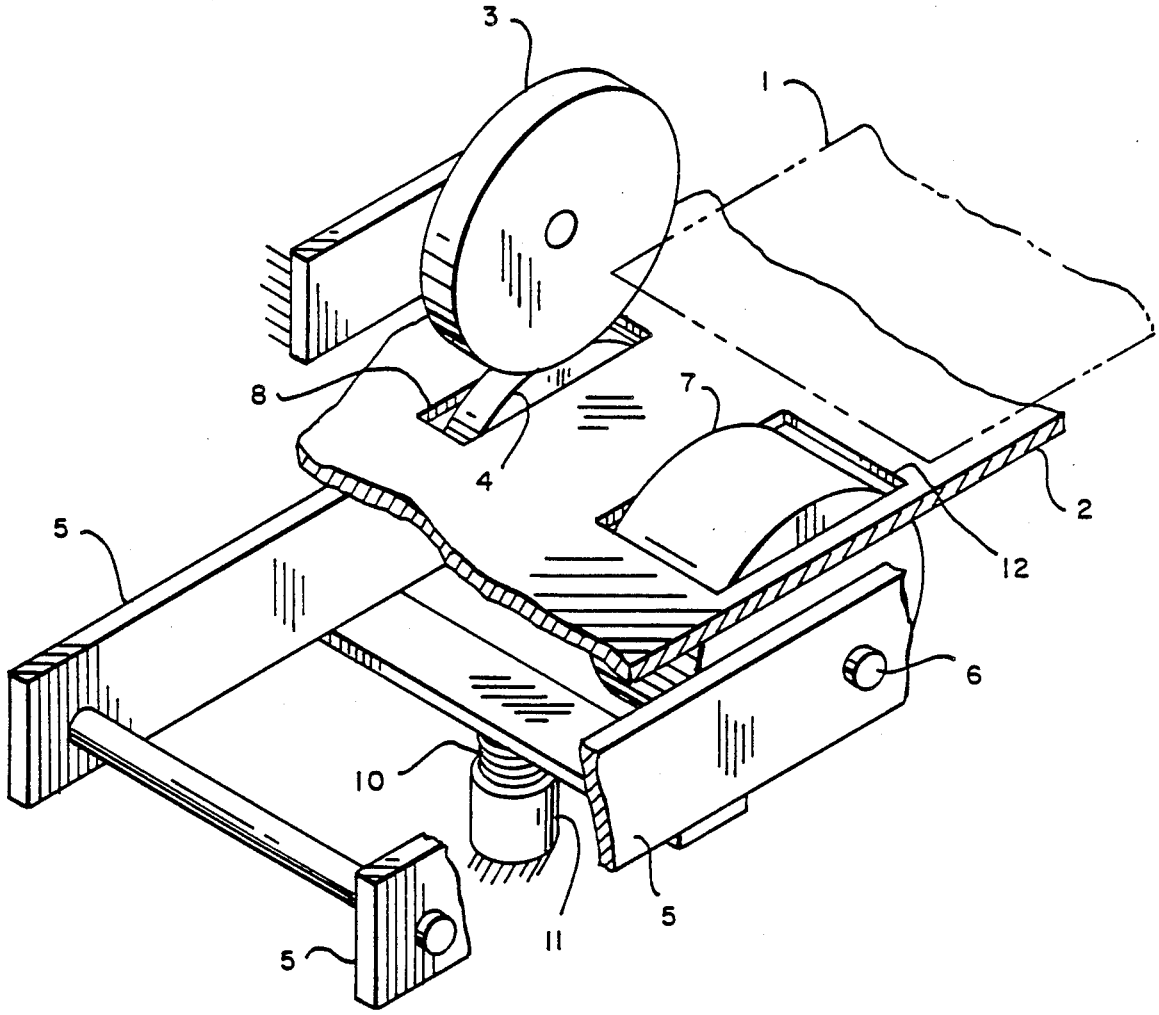
FIG. 3 is a top schematic perspective of the novel portion of the mailing machine of this invention.

In FIG. 3 bracket 5 and its bracket assembly is shown in perspective. The upper portion of the mailing machine assembly is cut away so that the prepositioning means is clearly visible. Bracket 5 is spring mounted below platen 2 by spring means 10. As the mailpiece 1 as shown in FIG. 1 travels between the nips of the rollers 3 and 4, it displaces roller 4 downwardly. Since reaction roller 4 and impression roller 7 share the same axle 6 both will be displaced by the mail thickness. All of the work done in displacing impression roller 7 is done independent from the meter or meter drum 9 thus prolonging the life of meter drum 9. Both the upper reaction roller 3 and the meter drum 9 assembly are directly mounted to the mailing machine structure and independent of both impression roller 7 and lower reaction roller 4. Platen 2 remains fixed in place unlike the conventional meters where the platen moves in conjunction with the thickness of the mailpiece.

The preferred and optimumly preferred embodiments of the present invention have been described herein and shown in the accompanying drawing to illustrate the underlying principles of the invention but it is to be understood that numerous modifications and ramifications may be made without departing from the spirit and scope of this invention.

What is claimed is:

1. An improved mailing machine having a mail deck and having a postage meter detachably mounted thereto such that a portion of said postage meter extends in a cantileved fashion over a portion of said mailing machine's mail deck, wherein the improvement comprises:

a elongated bracket pivotally mounted at one end to the underside of said mail deck;

a shaft rotatably mounted at the other end of said bracket;

a impression roller mounted centrally around a portion of said shaft in fixed axial location;

a lower reaction roller mounted centrally around another portion of said shaft in axially spaced apart relationship to said impression roller and in fixed axial location;

a upper reaction roller rotatably mounted to said mailing machine independently of said lower reaction roller and opposite to said lower reaction roller in a fixed vertical position;

means for biasing said bracket such that said lower reaction roller is in generally horizontal tangential communication with said upper reaction roller to define a nip therebetween, said mail deck having slots formed in said mail deck to allow a portion of said lower reaction roller and said impression roller to extend therethrough; and, said postage meter being mounted to said mailing machine such that said postage meter print drum is opposite said impression roller, whereby an envelope traversing the mail deck first encounters said nip between said upper and lower reaction rollers causing said bracket to pivotally displace said impression roller relative to the thickness of said envelope prior to said envelope encountering said print drum.

2. An improved mailing machine as claimed in claim 1 wherein said improvement further comprises said print drum having flattened surface opposite said impression roller in the undisplaced position.

* * * * *